US006250751B1

(12) United States Patent
Whitney et al.

(10) Patent No.: US 6,250,751 B1
(45) Date of Patent: Jun. 26, 2001

(54) INK JET PRINTER CARTRIDGE MANUFACTURING METHOD AND APPARATUS

(75) Inventors: Jon Brock Whitney, Georgetown; Gregory Alan Long, Lexington; Matthew Joe Russell, Stamping Ground, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/536,855

(22) Filed: Mar. 28, 2000

(51) Int. Cl.[7] ..... B41J 2/175
(52) U.S. Cl. ..... 347/87; 347/86
(58) Field of Search ..... 347/84, 85, 86, 347/87, 18

(56) References Cited

U.S. PATENT DOCUMENTS

| | | | | |
|---|---|---|---|---|
| 5,359,356 | | 10/1994 | Ecklund | 347/86 |
| 5,440,333 | | 8/1995 | Sykora et al. | 347/87 |
| 5,448,275 | | 9/1995 | Fong | 347/87 |
| 5,450,112 | | 9/1995 | Scheffelin | 347/87 |
| 5,515,092 | | 5/1996 | Swanson et al. | 347/87 |
| 5,767,882 | | 6/1998 | Kaplinsky et al. | 347/87 |
| 5,898,451 | | 4/1999 | Kaplinsky et al. | 347/87 |
| 5,923,353 | * | 7/1999 | Boyd et al. | 347/85 |
| 6,076,912 | * | 6/2000 | Murthy | 347/18 |

FOREIGN PATENT DOCUMENTS

| | | |
|---|---|---|
| 0 829 365 A2 | 3/1998 | (EP) . |
| 0 925 935 A2 | 6/1999 | (EP) . |

* cited by examiner

*Primary Examiner*—N. Le
*Assistant Examiner*—Anh T. W. Vo
(74) *Attorney, Agent, or Firm*—Luedeka, Neely & Graham

(57) ABSTRACT

The invention provides an improved ink jet cartridge for an ink jet printer and a method for making the improved ink jet cartridge. The ink jet cartridge includes a substantially inflexible frame having at least one pressure port, the frame having at least one peripheral edge. At least one malleable web is provided having a first side and a second side the first side being attached to the peripheral edge of the frame defining a substantially closed cavity. The malleable web is conformed to the cavity by applying a subatmospheric pressure to the cavity before, after or while heating the malleable web in order to substantially conform the web to the cavity thereby creating a variable volume cavity having a substantially predictable pressure/volume relationship. A biasing element is disposed adjacent the first or second side of the malleable web for biasing the web relative to the cavity. Because the malleable web is conformed to the cavity with heat and differential pressure, ink flow in and out of the ink cartridge is more predictable and the pressure in the ink cartridge is easier to maintained at a desired level thereby improving print quality.

29 Claims, 7 Drawing Sheets

INK JET PRINTER CARTRIDGE MANUFACTURING METHOD AND APPARATUS

TECHNICAL FIELD

This invention relates to the field of ink jet printers. More particularly this invention relates to an improved ink jet printer cartridge and a manufacturing method therefor.

BACKGROUND OF THE INVENTION

Ink jet printers require an ink supply to be in fluid contact with an ink drop ejecting device which precisely ejects ink onto a recording media. The ink supply must be maintained at a relatively constant pressure to keep the ink from discharging from the ejecting device at the wrong time or in an undesired amount. There are several methods and devices for maintaining a constant negative back-pressure including capillary fibers or foam, bladder-type configurations and lung-type configurations.

Bladder and lung configurations may consist of a rigid frame with either one or two side panels made of a thin plastic laminate material. Both configurations depend on a flexing of the side panels which is resisted by a biasing member located either between the side panels (bladder configurations) or between one of the side panels and a rigid panel attached to the frame (lung configurations). The resistance of the biasing member is predictable and linear as it compresses and expands. However, the thin film side panels often contain wrinkles which are of random size and distribution which ultimately make the system behavior erratic and unpredictable.

A previously used method of attaching the side panels to a frame was to place the flat laminate material on the bladder frame and use a shim to depress the material some distance into the frame interior as the laminate material was being heated in order to conform the web to a cavity defined by the frame. The side panels were then heat sealed to the frame perimeter, allowing the spring to flex through a specified range of motion. This method had the undesirable effect of introducing wrinkles into the topology of the side panels.

Wrinkles or irregularities of the side panels result in sub-optimal performance characteristics such as hysteresis and erratic back-pressure/volume relationships in the ink reservoir. This erratic behavior translates into large back-pressure fluctuations during operation which can affect ink spot size, and/or timing and, ultimately, print quality. Furthermore, these problems are exacerbated in a refillable reservoir design in which the bladder spring is used both as a back-pressure device as well as a pump to refill the reservoir with ink. Hysteresis and back-pressure fluctuations can prevent the ink cartridge from being completely or reproducibly refilled with ink. What is needed, therefore, is an apparatus and a manufacturing method for the apparatus, which enables predictable and consistent back-pressure on the ink supply during use.

SUMMARY OF THE INVENTION

The foregoing and other needs are provided by an improved ink cartridge for an ink jet printer and improved manufacturing method therefor. According to the invention, a method for manufacturing a pressure control device for an ink jet cartridge is provided. Tile method includes providing a substantially inflexible frame having at least one pressure port, the frame having at least one peripheral edge. At least one malleable web having a first side and a second side is provided. The first side of the malleable web is attached to the peripheral edge of the frame, thereby defining a substantially closed cavity. A subatmospheric pressure is applied to the cavity through the pressure port before, after or while heating the malleable web to a temperature sufficient to soften and mold the web so that the web substantially conforms to the cavity. The resulting cavity has a variable volume and a substantially predictable pressure/volume relationship. A biasing means is disposed adjacent the first or second side of the conformed web to bias the web relative to the cavity during ink use and refilling.

In another aspect the invention provides an ink jet pen for use in an ink jet printer. The pen includes an ink jet cartridge body and ink jet cartridge attached to the cartridge body. The ink jet cartridge contains ink and has a substantially predictable pressure/volume relationship. The ink jet cartridge also includes a substantially inflexible frame having at least one pressure port. The frame has at least one peripheral edge. At least one malleable web having a first side and a second side, is attached to the peripheral edge of the frame thereby defining a substantially closed cavity. The malleable web is conformed to the cavity by applying a subatmospheric pressure to the cavity before, after or while heating the malleable web to substantially conform the web to the cavity thereby providing a cavity having a variable volume and having a substantially predictable pressure/volume relationship. A biasing means is disposed adjacent the first or second side of the malleable web for biasing the web relative to the cavity.

In a preferred embodiment, a masking device is used during the web heating step in order to reduce irregularities to the frame walls and edges of the web caused by excessive heat applied thereto. By use of the methods of this invention, side wall or web irregularities are substantially reduced or eliminated which provides for a more uniform pressure/volume relationship in the ink reservoir. Hysteresis effects due to the aforementioned irregularities are also substantially reduced or eliminated according to the invention described herein. By substantially eliminating the side wall or web irregularities, improved performance characteristics such as ink spot size and print quality are correspondingly improved.

In the case of a refillable ink cartridge or ink reservoir, reduction or elimination of hysteresis and back-pressure variations enables in a more complete refill of the reservoir. Moreover, by masking specified areas of the ink jet cartridge before heating and applying pressure, according to the invention, side wall warping or web deformations are greatly reduced in areas not intended to be molded thereby improving the integrity of the ink jet cartridge as an ink container.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
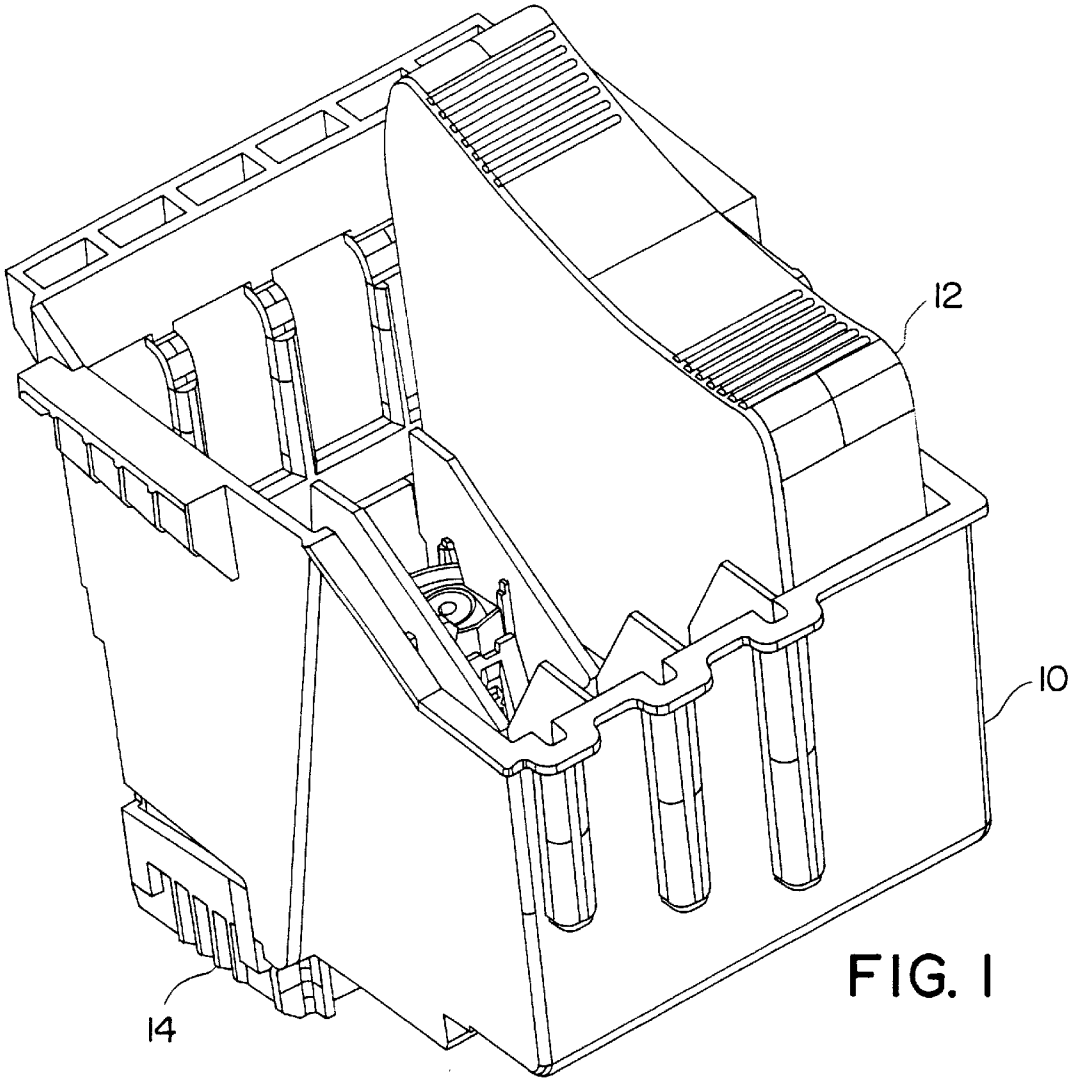
FIG. 1 is a perspective view of a cartridge body containing an ink jet cartridge according to the invention.
Figure 2:
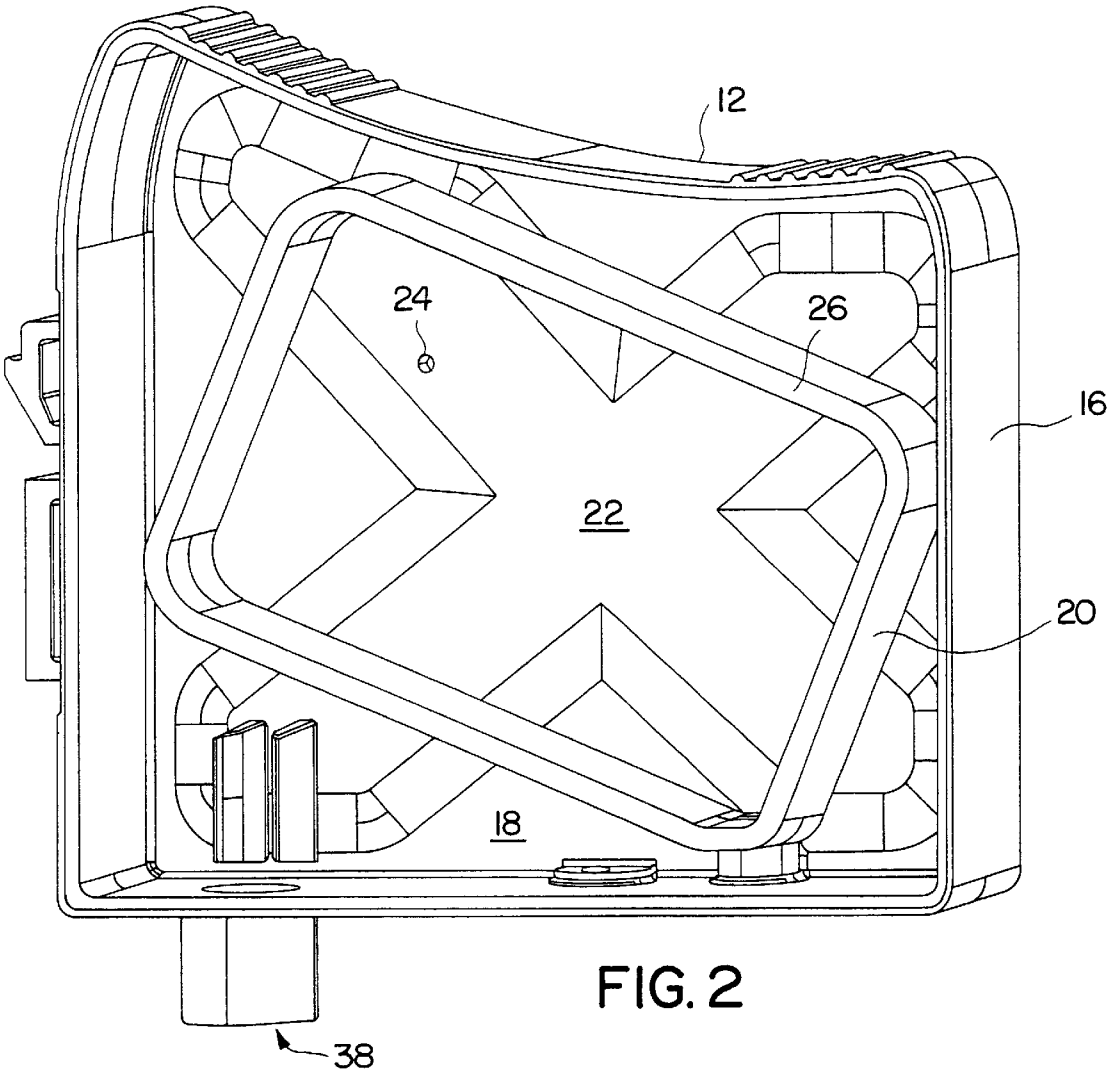
FIG. 2 is a side perspective view of a portion of an ink cartridge according to the invention.

With reference now to FIGS. 1 and 2 there is shown a perspective view of an ink cartridge body 10 containing an ink cartridge 12 for an ink jet printer according to the invention. The ink cartridge body 10 contains at least one ink cartridge 12, and preferably multiple ink cartridges 12 for providing ink to ink jet pens attached to the cartridge body 10 for ink ejection onto recording medium, such as paper. Tile ink jet pens are attached to an opposing side 14 of the cartridge body 10 to which ink jet cartridge 12 containing ink is attached. The ink jet cartridge 12 will be further broken down into respective components and described in greater detail below.

Figure 3:
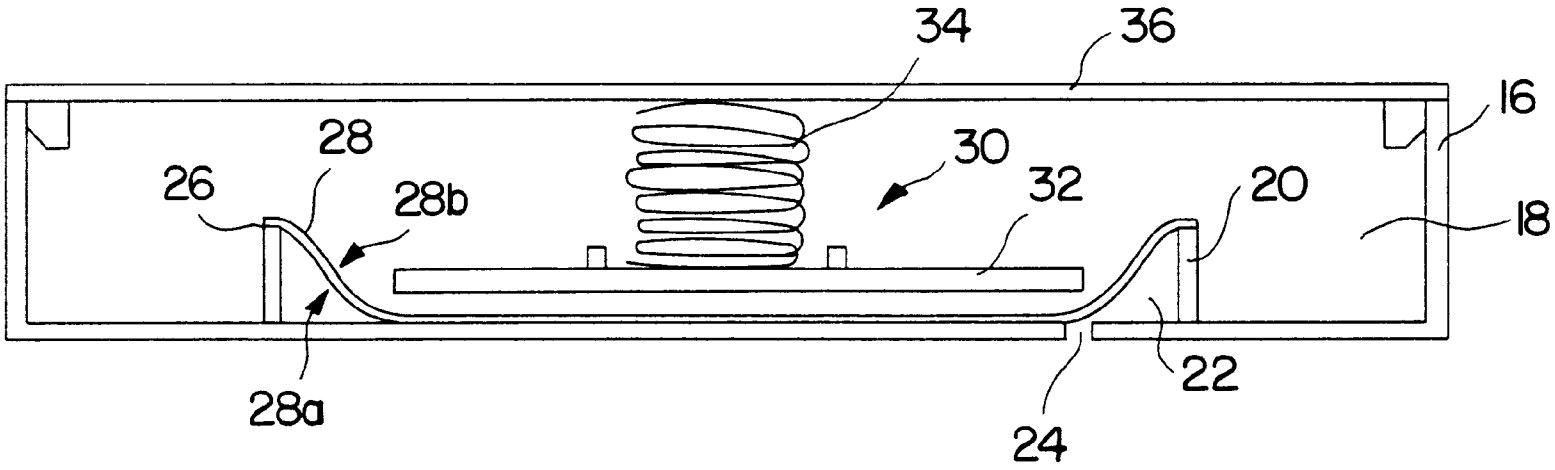
FIG. 3 is a side cross-sectional view, not to scale, of a lung-type pressure control device in an ink cartridge according to the invention.

Referring to FIG. 2, ink jet cartridge 12 contains a substantially inflexible outer frame 16 defining an ink cavity 18 and a substantially inflexible inner frame 20 defining a pressure control cavity 22 containing at least one pressure port 24 wherein a pressure differential may be applied to a cavity 22. As shown in FIGS. 2 and 3, pressure port 24 provides fluid communication between the interior 22 defined by inner frame 20 and an external pressure differential inducing source.

Referring again to FIG. 2, the inner and outer frame 20 and 16 respectively of the ink cartridge 12 are preferably constructed of a substantially rigid materials selected from the group consisting of metal, polymeric materials, glass and ceramic materials. The inner frame 20 further includes at least one peripheral edge 26. Peripheral edge 26 provides an attachment surface for a pressure control member as described in more detail below.

As shown in FIG. 3, at least one malleable web 28 is provided. The malleable web 28 has a first side 28*a* and a second side 28*b*. The malleable web 28 may be a mono-layer film, metallized film or a plastic laminate comprised of laminar layers of material. The material layers may be selected from the group of polymeric materials consisting of polyvinylidene chloride, polyethylene, polypropylene, polyamide, and polyethylene teraplithalate, and combinations of two or more of the foregoing, as well as metallized films made with the foregoing polymeric materials. If a laminate containing two or more polymeric layers is used as the malleable web 28, the laminate is preferably composed of materials with plastic deformation temperatures which are relatively close to one another such as polyamide, polyethylene or polypropylene. Having close laminate deformation properties enables the laminate to be molded or otherwise configured resulting in a substantially uniform end product.

Metallized film may also be used as a material for web 28 due to the low vapor transmission rate that metals provide. If a metallized film is used as the web 28, it is preferred that the first side 28*a* of the web 28 be comprised of a polymeric material most preferably a thermoplastic polymeric material.

As seen in FIG. 3, the first side 28*a* of web 28 is attached to the peripheral edge 26 of the inner frame 20 and together define a substantially closed pressure control cavity 22. The web 28 may be heat-sealed to or welded to the peripheral edge 26 of inner frame 20 or an adhesive may be used to secure the web 28 to the peripheral edge 26 of inner frame 20, thereby forming a hermetically sealed pressure control cavity 22.

According to the invention, after attaching the web 28 to the peripheral edge 26 of the inner frame 20, the malleable web 28 is conformed to the cavity 22 by applying a subatmospheric pressure to the cavity 22 through the pressure port 24 before, after or while heating the malleable web 28 to a temperature sufficient to substantially conform the web 28 to the cavity 22. The subatmospheric pressure induces a pressure differential between surface 28*a* and 28*b* thereby conforming the web to the cavity 22. Surface irregularities and wrinkles in the web 28 are substantially reduced or eliminated as a result of the combined effect of heat application and an induced pressure differential on the web 28.

Those skilled in the art will readily recognize that there are a variety of methods and means to heat the malleable web 28 to conform the web 28 to the cavity 22. According to the invention, an infrared light, heat lamp or hot air is preferably use to heat malleable web 28 during the pressuring and heat forming step. Likewise, there are a variety of methods for introducing a pressure differential on the web 28. Accordingly, the invention is not intended to be limited to the specific disclosures herein. Because of the application of a subatmospheric pressure or pressure differential on web 28 during the heating step, a shim is not required to depress the web 28 during heat application to the web 28.

By introducing a subatmospheric pressure in cavity 22 before, after or while applying heat to the malleable web 28, a substantially uniform web 28 which is essentially free of wrinkles and surface iregularities is produced. Furthermore, another benefit of the present invention is that a variable volume of the ink cavity 18 having a substantially predictable pressure-volume relationship is provided due to the substantially uniformly conformed malleable web 28. Since the cavity 22 volume is substantially predictable, hysteresis and back-pressure variations are substantially minimized, resulting in uniform ink spot size and improved print quality characteristics.

For a web 28 made of polypropylene film having a thickness of about 3 mils, it is preferred to heat the web 28 for about 4.5 seconds at about 150° C. while applying a subatmospheric pressure to cavity 22 of about 25 inches of mercury for about five seconds. Other web materials may require longer or shorter heating and pressure times, higher or lower temperatures and higher or lower pressures. However, for a wide variety of thermoplastic polymeric materials having properties similar to polypropylene. the foregoing times, temperatures and pressures are sufficient to achieve the purposes of the invention.

After conforming the web 28 to cavity 22, a biasing member 30 including a substantially rigid plate 32 and a biasing means 34 selected from a coil spring, leaf spring, foam and the like is placed adjacent the second side 28*b* of web 28. Those skilled in the art will recognize that a variety of biasing means 34 may be used and FIG. 3 is not intended to limit the invention to the described embodiments. A substantially rigid cover 36 is then attached the outer frame members 16 of the cartridge 12 by welding, adhesives and the like in order to provide a liquid tight ink cavity 18 with the biasing means 34 between the rigid cover 36 and the web 28. The foregoing web 28 and biasing means is commonly referred as a "lung-type" pressure control device.

Prior to filling the ink cavity 18 with ink, the cavity 18 is maintained at substantially atmospheric pressure and the web 28 is conformed to cavity 22 by biasing means 34. Ink is then introduced into ink cavity through ink supply port 38 (FIG. 2) to fill the cavity 18 with ink. After filling the cavity 18 with ink, a portion of the ink is removed from the ink cavity 18 to provide a subatmospheric pressure ranging from about 2 to about 3 inches of water column in cavity 18. As the volume of ink in cavity 18 decreases due to printing operations the cavity volume decreases as web 28 moves toward cover 36. Biasing means 34 resists movement of plate 32 toward cover 36 thereby maintaining a substantially constant pressure in ink cavity 18 ranging from about negative 2 to about negative 3 inches water.

Figure 4:
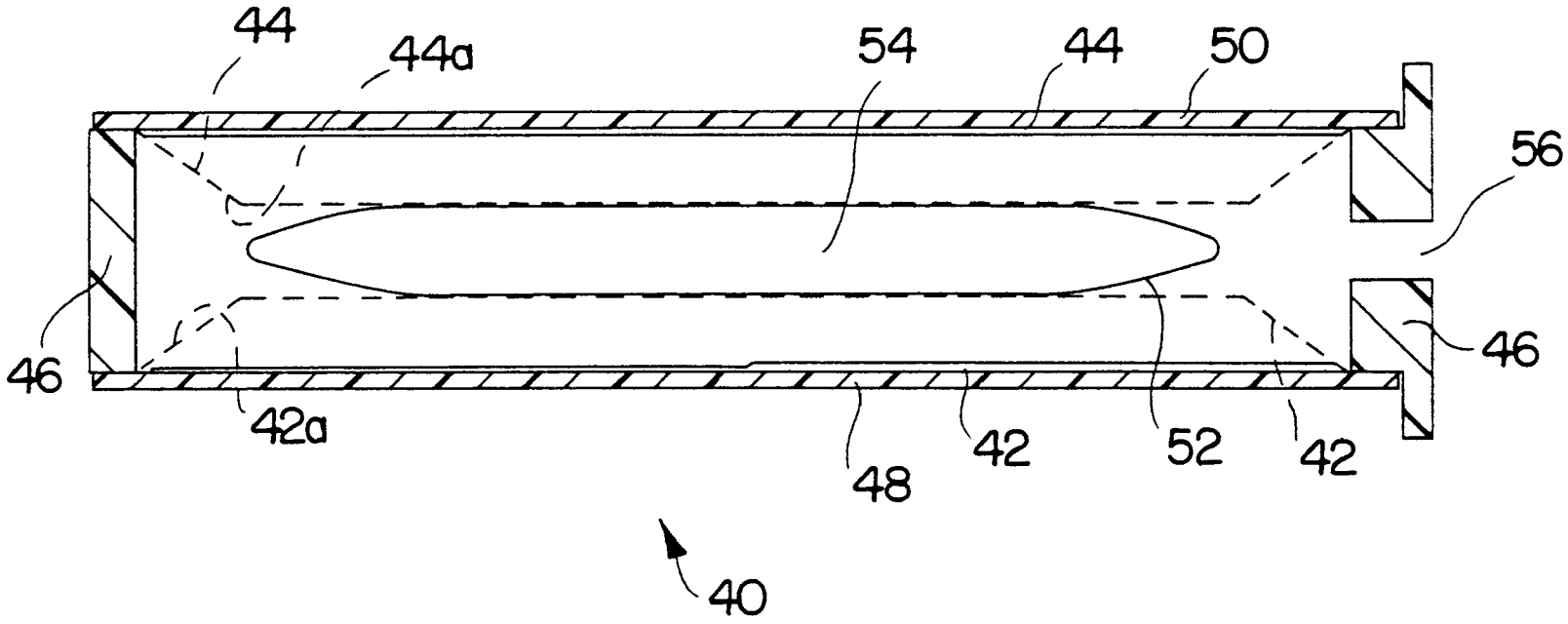
FIG. 4 is a cross-sectional view, not to scale, of a bladder-type pressure control device for an ink cartridge according to the invention.

Referring now to FIG. 4, an ink cartridge 40 containing a bladder-type pressure control configuration according to the present invention is illustrated. The foregoing description applies equally well to the bladder-type pressure control device with the distinction that for the bladder-type configuration, two malleable webs 42 and 44 are attached to a substantially rigid frame 46. In all other respects, the webs are conformed with heat and pressure as described above. The cartridge 40 also contains rigid covers 48 and 50 to protect the webs 42 and 44.

As shown, in a preferred embodiment of the invention, biasing means 52 is located adjacent the first sides 42*a* and 44*a* of the malleable webs 42 and 44. The biasing means 52 is preferably selected from the group consisting of leaf springs, coil springs and resilient foam. Those skilled in the art will recognize that a variety of biasing means 52 may be used in the alternative embodiment and FIG. 4 is not intended to limit the invention to the described embodiments.

Biasing means 52 aids in maintaining a substantially linearly varying subatmospheric pressure within ink cavity 54. Bladder-type configurations normally contain ink within cavity 54 which is between webs 42 and 44. A negative pressure throughout cavity 54 is essential to prevent untimely or unwanted ejection of ink from cartridge 40. A preferred pressure in cavity 54 ranges from about negative 2 to about negative 3 inches of water. As ink in cavity 54 flows through ink outlet port 56 of cartridge 40 during a printing, operation the cavity 54 volume will decrease as shown by broken lines representing webs 42 and 44. Biasing means 52 acts to apply an opposing force to the contracting force of the cavity 54 as ink flows from cartridge 40 to the ink jet pens thereby maintaining a desired subatmospheric pressure in cavity 54. Moreover, according to the present invention, ink contained within the ink cartridge 40 will tend to eject less erratically than with conventional systems due to the resulting uniformity of the heat and pressure treated webs 42 and 44 as described above.

Figure 5:
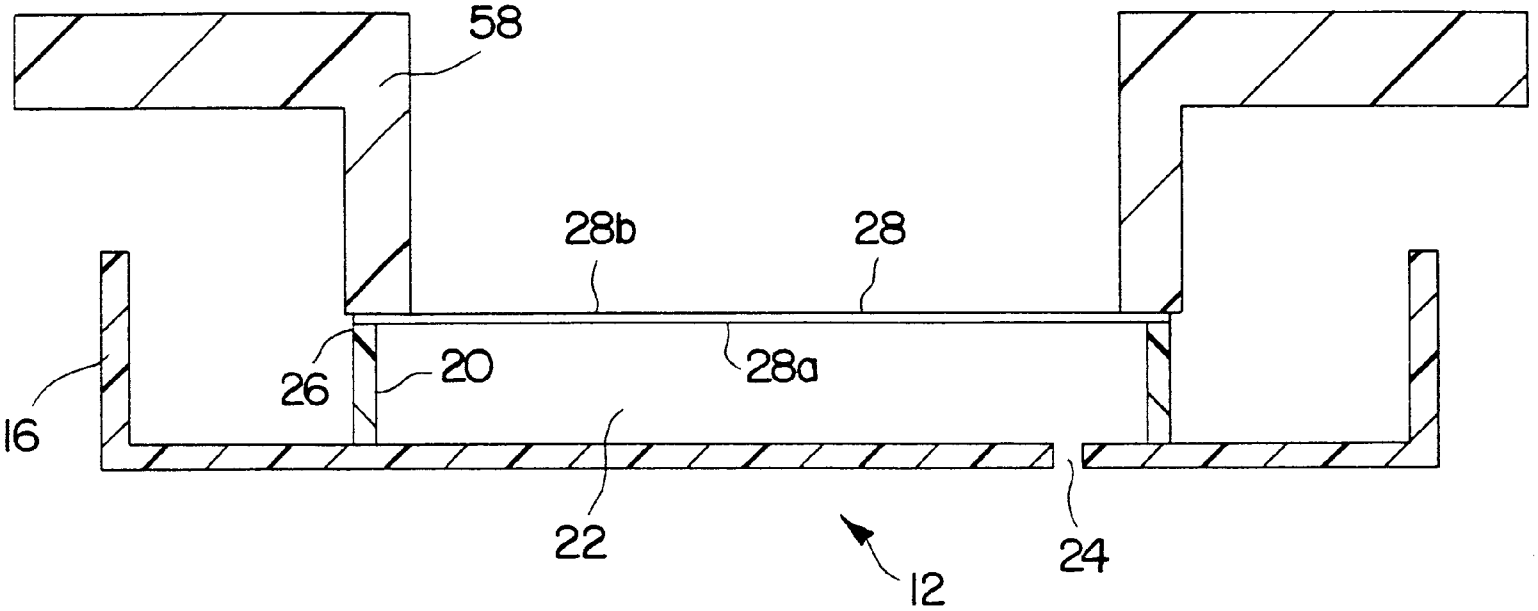
FIG. 5 is a cross-sectional view, not to scale, of masking device applied to a frame of an ink cartridge during manufacture of a pressure control device according to the invention.

A preferred method for manufacturing a pressure control device for the ink jet cartridge 12 will now be described with reference to FIG. 5. According to the invention, a substantially inflexible inner frame 20 is provided. The frame 20 contains at least one peripheral edge 26, which is used as an attachment surface, as described above for web 28. Frame 20 further contains at least one pressure port 24 wherein a differential pressure may be applied to pressure control cavity 22. Pressure port 24 provides fluid communication between the pressure control cavity 22 and an external pressure differential inducing source. There are a variety of methods for inducing a pressure differential in cavity 22 and those skilled in the art will realize that the invention is not intended to be limited to the specific disclosures herein.

At least one malleable web 28 is provided, having a first side 28*a* and a second side 28*b*, as described above. The first side 28*a* of the malleable web 28 is attached to the peripheral edge 26 of the frame 20, thereby defining a substantially closed cavity 22. The web 28 may be heat-sealed to the peripheral edge 26 in the case of a web 28 which is composed of a mono-layer of a thermoplastic material or a laminate having a side 28*a* made of a thermoplastic material. In the alternative, an adhesive may be used to secure the web 28 to the peripheral edge 26 of frame 20, thereby forming a hermetically sealed cavity 22.

After attaching the web 28 to the peripheral edge 26 of frame 20, a thermal masking device 58 is attached adjacent the peripheral edge 26 of the frame 20 with the web 28 between peripheral edge 26 and the masking device 58. It is preferred to use a thermal masking device 58 in order to prevent or reduce deformation or irregularities of the malleable web 28 adjacent the peripheral edge 26 of inner frame 20 which may be induced by the web deformation step, as further described below. In the case of a polymeric ink cartridge 12 and frame 20, the masking device 58 may also prevent or reduce deformation or warping of the inner frame 20. However, in the case where an adhesive, instead of heat, is preferably used to attach the malleable web 28 to the peripheral edge 26 of the frame 20 and/or in the case of a metal frame 20, a masking device 58 may not be required.

A differential pressure is applied to the web 28 by inducing a subatmospheric pressure in cavity 22 through the pressure port 24 before, during or while heating the malleable web 28 to a temperature sufficient to soften and mold the web 28. The induced pressure and applied heat substantially conforms web 28 to the cavity 22, thereby creating a variable volume of the cavity 22 having a substantially predictable pressure-volume relationship.

Figure 6A:
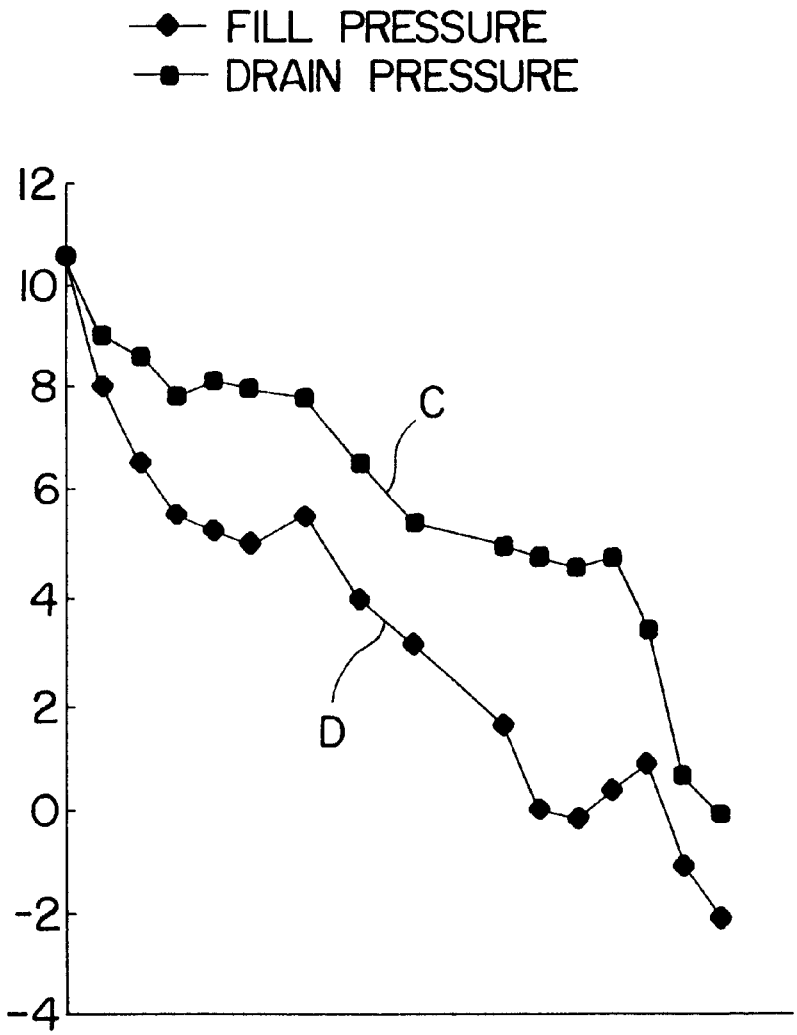
FIG. 6*a* is a graphical representation of the refill and drain pressure/volume relationship for a prior art pressure control device for an ink cartridge.
Figure 6B:
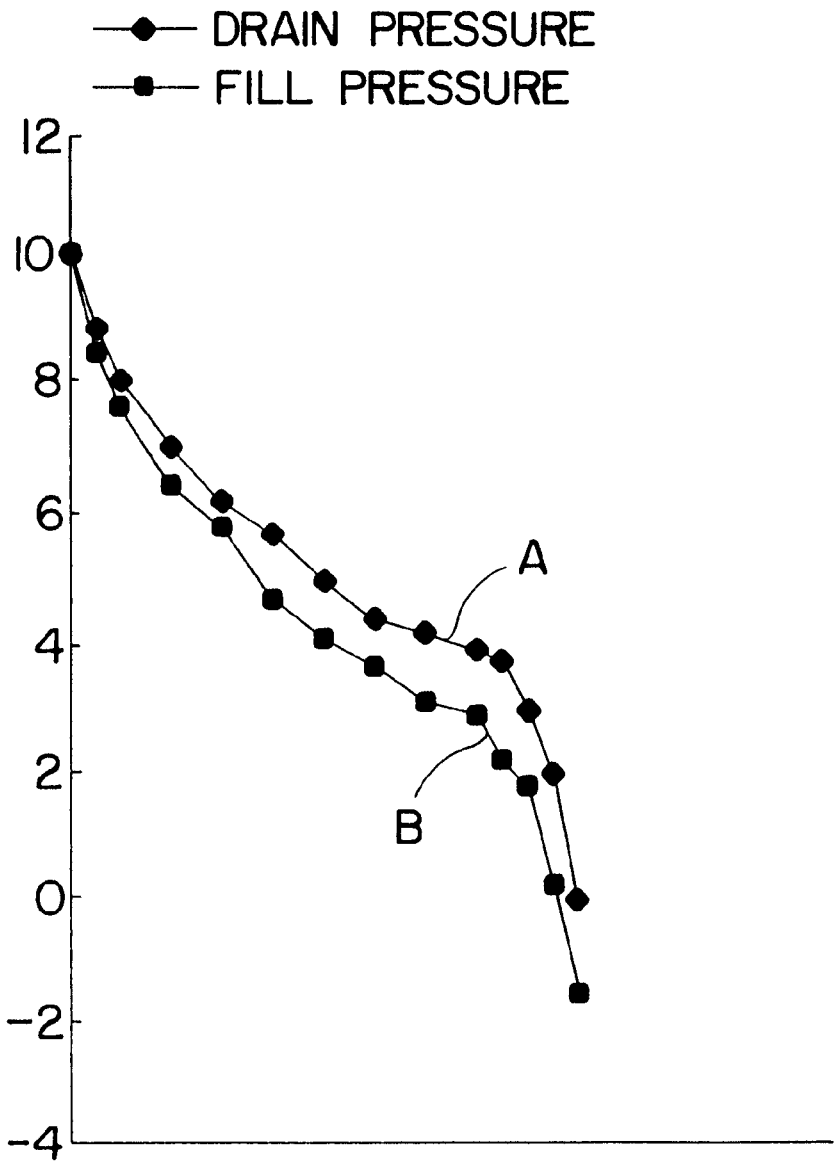
FIG. 6*b* is a graphical representation of the refill and drain pressure/volume relationship for a pressure control device for an ink cartridge according to the invention.

With regard to the improved pressure/volume relationships provided by the apparatus of the invention, reference is made to FIGS. 6*a* and 6*b*. FIG. 6*a* illustrates the relatively erratic pressure/volume relationship of an ink cartridge upon filling and draining which contains a conventional bladder or lung-type pressure control device. In contrast. FIG. 6*b* illustrates the relatively predictable pressure/volume relationship of an ink cartridge 12 containing the bladder- or lung-type pressure control device according to the invention. As illustrated by FIG. 6*b*, the difference between the pressure/volume curves of a bladder- or lung-type device upon draining or filling an ink cartridge 12 made according to the invention is substantially more predictable as evidenced by FIG. 6*b* than a similar ink cartridge made by a conventional method.

From the volume vs. pressure curves of FIG. 6*b*, it is possible to calculate a pressure difference between the ink removal curve A and the ink filling or refilling curve B at any given ink cavity volume. The difference between curve A and curve B is commonly referred to as hysteresis. In the example given in FIG. 6*b*, the average difference between curves A and B is about 0.9 cm negative water column and this difference is relatively uniform for all volumes of ink. In contrast, the average difference between curves C and D of FIG. 6*a* is about 2.6 cm negative water column and the difference varies dramatically for all volumes of ink.

If the pressure control system has a large hysteresis as illustrated by FIG. 6*a*, predictability of performance is inhibited because there will be a large pressure difference within a relatively small volume difference. A large pressure difference may occur when the ink cartridge is first used. Accordingly, an ink cartridge may start out with a relatively low subatmospheric pressure and within a page of printing the subatmospheric pressure may increase substantially. A sudden change in pressure in the ink cavity may cause ink droplet variation which would inhibit print quality. The invention as described above improves print quality by providing a more predictable pressure/volume relationship as illustrated by FIG. 6*b*.

It is contemplated, and will be apparent to those skilled in the art from the preceding description and the accompanying drawings, that modifications and changes may be made in the embodiments of the invention. Accordingly, it is expressly intended that the foregoing description and the accompanying drawings arc illustrative of preferred embodiments only, not limiting thereto, and that the true spirit and scope of the present invention be determined by reference to the appended claims.

What is claimed is:

1. A method for manufacturing a pressure control device for an ink jet cartridge, the method comprising the steps of:

providing a substantially inflexible frame having at least one pressure port, the frame having at least one peripheral edge;

providing at least one malleable web, having a first side and a second side;

attaching the first side of the malleable web to the peripheral edge of the frame, thereby defining a substantially closed cavity;

applying a subatmospheric pressure to the cavity through the pressure port before, after or while heating the malleable web to a temperature sufficient to soften and mold the web so that the web substantially conforms to the cavity, thereby providing a cavity having a variable volume; and providing a biasing means adjacent the first or second side of the conformed web to bias the web relative to the cavity.

2. The method of claim 1, wherein the malleable web comprises a polymeric laminate material.

3. The method of claim 1, wherein the malleable web conformed to the cavity by heating the web using a heating device selected from the group consisting of an infrared lamp, a heat lamp or a hot air producing device.

4. The method of claim 1, wherein the biasing means is adjacent the first side of the malleable web.

5. The method of claim 1 wherein the biasing means is adjacent the second side of the malleable web.

6. The method of claim 1, wherein the biasing means is selected from the group consisting of leaf springs, coil springs and resilient foam.

7. The method of claim 1, wherein the malleable web is comprised of laminar layers of material selected from the group of polymeric materials consisting of polyvinylidene chloride, polyethylene, polypropylene, polyamide, and polyethylene teraplithalate, and combinations of two or more of the foregoing, as well as metallized films made from the foregoing polymeric materials.

8. The method of claim 1 further comprising attaching a thermal masking device to the peripheral edge of the frame prior to applying heat to the web.

9. An ink jet pen for use in an ink jet printer, the pen including an ink jet cartridge body and ink jet cartridge attached to the cartridge body, the ink jet cartridge containing ink and comprising:

a substantially inflexible frame having at least one pressure port, the frame having at least one peripheral edge;

at least one malleable web having a first side and a second side, the first side being attached to the peripheral edge of the frame thereby defining a substantially closed cavity, wherein the malleable web is substantially conformed to the cavity by applying a subatmospheric pressure to the cavity before, after or while heating the malleable web, thereby providing a cavity having a variable volume, and biasing means adjacent the first or second side of the malleable web for biasing the web relative to the cavity.

10. The ink jet pen of claim 9, wherein the ink jet cartridge body is comprised of material selected from the group consisting of metal, polymeric materials, glass and ceramic materials.

11. The ink jet pen of claim 9, wherein the ink is contained within the variable volume cavity.

12. The ink jet pen of claim 9, wherein the ink is external to the variable volume cavity.

13. The ink jet pen of claim 9, wherein the malleable web comprises a polymeric laminate.

14. The ink jet pen of claim 9, wherein the biasing means is adjacent the first side of the malleable web.

15. The ink jet pen of claim 9, wherein the biasing means is adjacent the second side of the malleable web.

16. The ink jet pen of claim 9, wherein the biasing means is selected from the group consisting of leaf springs, coil springs and resilient foam.

17. The ink jet pen of claim 9, wherein the malleable web is comprised of laminar layers of material selected from the group of polymeric materials consisting of polyvinylidene chloride, polyethylene, polypropylene, polyamide, and polyethylene teraplithalate, and combinations of two or more of the foregoing, as well as metallized films made from the foregoing polymeric materials.

18. The ink jet pen of claim 9 wherein the at least one malleable web provides the cavity as having substantially similar ink pressure-to-volume relationships upon filling and draining the cavity, the pressure-to-volume relationships defined by a first curve representing ink pressure versus volume during filling of the cavity, and a second curve representing ink pressure versus volume during draining of the cavity, where the first and second curves have substantially the same slope at corresponding volumes points.

19. The ink jet pen of claim 9 wherein the at least one malleable web provides the cavity as having substantially similar ink pressure-to-volume relationships upon filling and draining the cavity, the pressure-to-volume relationships defined by a first curve representing ink pressure versus volume during filling of the cavity, and a second curve representing ink pressure versus volume during draining of the cavity, where a difference between pressure values at corresponding volume points in the first and second curves is substantially constant.

20. The ink jet pen of claim 19 wherein the difference between pressure values at corresponding volume points in the first and second curves is no greater than about 0.9 centimeter negative water column.

21. An ink jet cartridge for an ink jet printer, the ink jet cartridge comprising:

a substantially inflexible frame having at least one pressure port, the frame having at least one peripheral edge;

at least one malleable web having a first side and a second side, the first side being attached to the peripheral edge of the frame defining a substantially closed cavity, wherein the malleable web is conformed to the cavity by applying a subatmospheric pressure to the cavity before, after or while heating the malleable web in order to substantially conform the web to the cavity thereby creating a variable volume cavity, biasing means adjacent the first or second side of the malleable web for biasing the web relative to the cavity, and ink in the ink jet cartridge for printing on a print media.

22. The ink jet cartridge of claim 21, wherein the ink is contained within the variable volume cavity.

23. The ink jet cartridge of claim 21, wherein the ink is external to the variable volume cavity.

24. The ink jet cartridge of claim 21, wherein the malleable web comprises a polymeric laminate.

25. The ink jet cartridge of claim 21, wherein the biasing means is adjacent the first side of the malleable web.

26. The ink jet cartridge of claim 21, wherein the biasing means is adjacent the second side of the malleable web.

27. The ink jet cartridge of claim 21, wherein the biasing means is selected from the group consisting of a leaf springs, coil springs and resilient foam.

28. The ink jet cartridge of claim 21, wherein the malleable web is comprised of laminar layers of material selected from the group of polymeric materials consisting of polyvinylidene chloride, polyethylene, polypropylene, polyamide, and polyethylene teraplithalate, and combinations of two or more of the foregoing, as well as metallized films made from the foregoing polymeric materials.

29. The ink jet cartridge of claim 21, wherein the ink jet cartridge body is comprised of material selected from the group consisting of metal, polymeric materials, glass and ceramic materials.

* * * * *